US008961053B1

(12) United States Patent
Esposito

(10) Patent No.: US 8,961,053 B1
(45) Date of Patent: Feb. 24, 2015

(54) LIPSTICK BLOTTING SYSTEM

(71) Applicant: Barbara Esposito, Delray Beach, FL (US)

(72) Inventor: Barbara Esposito, Delray Beach, FL (US)

( * ) Notice: Subject to any disclaimer, the term of this patent is extended or adjusted under 35 U.S.C. 154(b) by 123 days.

(21) Appl. No.: 13/903,264

(22) Filed: May 28, 2013

Related U.S. Application Data

(63) Continuation-in-part of application No. 13/363,562, filed on Feb. 1, 2012, now abandoned.

(51) Int. Cl.
*A45D 34/04* (2006.01)
*A45D 40/26* (2006.01)

(52) U.S. Cl.
CPC ..... *A45D 40/26* (2013.01); *A45D 34/04* (2013.01)
USPC ..... 401/196; 401/11; 401/172

(58) Field of Classification Search
USPC ..... 401/9, 10, 11, 110, 175, 178, 196
See application file for complete search history.

(56) References Cited

U.S. PATENT DOCUMENTS

| | | | |
|---|---|---|---|
| 4,628,564 | A | 12/1986 | Youssef |
| 4,699,161 | A | 10/1987 | Smith et al. |
| 5,285,799 | A | 2/1994 | Minard |
| D354,374 | S | 1/1995 | Battaglia |
| 6,013,344 | A | 1/2000 | Corbins |
| D456,099 | S | 4/2002 | Look |
| 7,310,846 | B1 | 12/2007 | Archibeque et al. |
| 2009/0258326 | A1 | 10/2009 | Al-Sulaiman et al. |

*Primary Examiner* — David Walczak
*Assistant Examiner* — Joshua Wiljanen

(57) ABSTRACT

The present invention features a lipstick blotting system for use after lipstick application featuring a tubular stationary base with a first guide rod. The system features a rotating base with a threaded rod. The stationary base is located inside the rotating base. The system features a carrier with an internally threaded tube. The carrier features a first guide aperture. The carrier is placed on the rotating base via the internally threaded tube placed onto the threaded rod. The carrier is inhibited from rotation via the first guide rod slid through the first guide aperture. The system features a linear blotter located on a carrier anterior surface. The blotter features a linear channel for placing over the tube. The system features a solution located in the rotating base and a cap adapted to attach and seal to a stationary base anterior end.

10 Claims, 4 Drawing Sheets

LIPSTICK BLOTTING SYSTEM

CROSS REFERENCE

This application claims priority to U.S. patent application Ser. No. 13/363,562 filed Feb. 1, 2012, the specification of which is incorporated herein in its entirety by reference.

FIELD OF THE INVENTION

The present invention relates to lipstick blotting systems.

BACKGROUND OF THE INVENTION

Lipstick is a commonly used cosmetic that is believed to enhance the appearance of a wearer; however, a side effect is that lipstick has a tendency to get onto the wearer's teeth unknowingly. Sometimes after application, the wearer may blot their lipstick covered lips by using a napkin or a cloth. The present invention features a lipstick blotting system for use after lipstick application.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a lipstick blotting system for use after lipstick application. In some embodiments, the system comprises a tubular stationary base. In some embodiments, a first guide rod is located on and extends out and away from a stationary base posterior end. In some embodiments, a shoulder is located around the stationary base.

In some embodiments, the system comprises a rotating base. In some embodiments, the rotating base comprises a threaded rod securely located on a rotating base posterior end interior surface. In some embodiments, the stationary base is located inside the rotating base. In some embodiments, the rotating base is rotatable in a first direction and a second direction when holding the stationary base.

In some embodiments, the system comprises a carrier. In some embodiments, the carrier comprises an internally threaded tube located on and projecting out and away from a carrier anterior surface. In some embodiments, the carrier comprises a first guide aperture located on a carrier first side thereon. In some embodiments, the carrier is located in the rotating base via the internally threaded tube threaded onto the threaded rod. In some embodiments, the carrier is inhibited from rotation via the first guide rod slid through the first guide aperture.

In some embodiments, the system comprises a linear blotter located on a carrier anterior surface. In some embodiments, the blotter comprises a linear channel centrally located. In some embodiments, the blotter is placed over the tube via the channel. In some embodiments, the system comprises a solution located in the rotating base. In some embodiments the system comprises a cap. In some embodiments, the cap is adapted to attach and seal to the stationary base anterior end.

DESCRIPTION OF PREFERRED EMBODIMENTS

Figure 1:
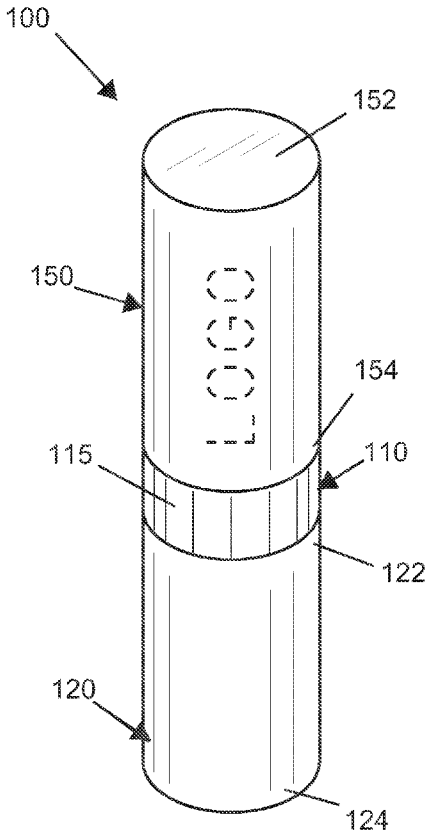
FIG. 1 shows a perspective view of the present invention.
Figure 2:
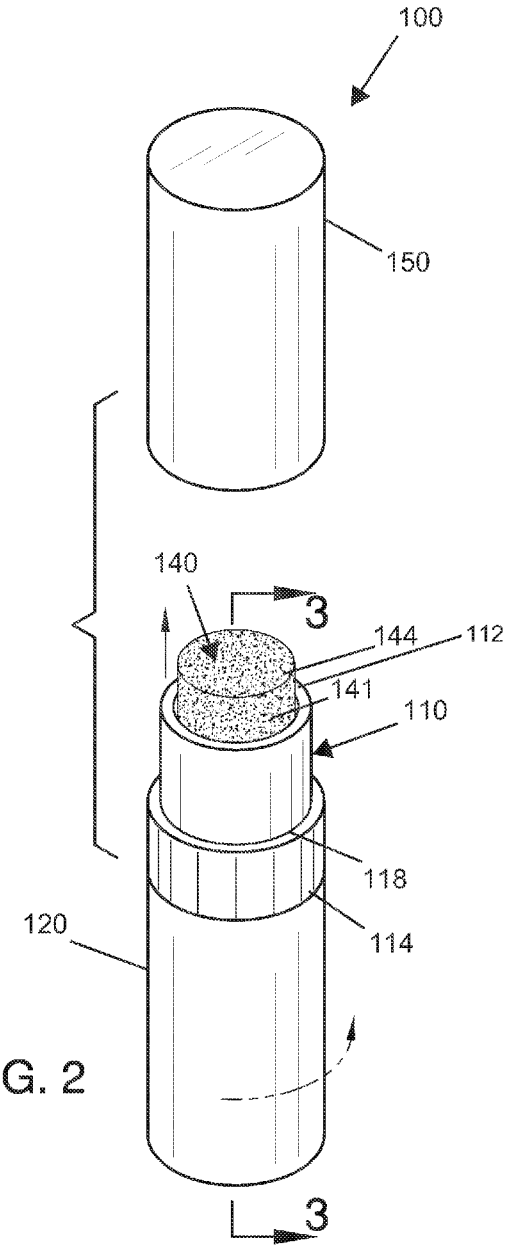
FIG. 2 shows a perspective view of the present invention.
Figure 3:
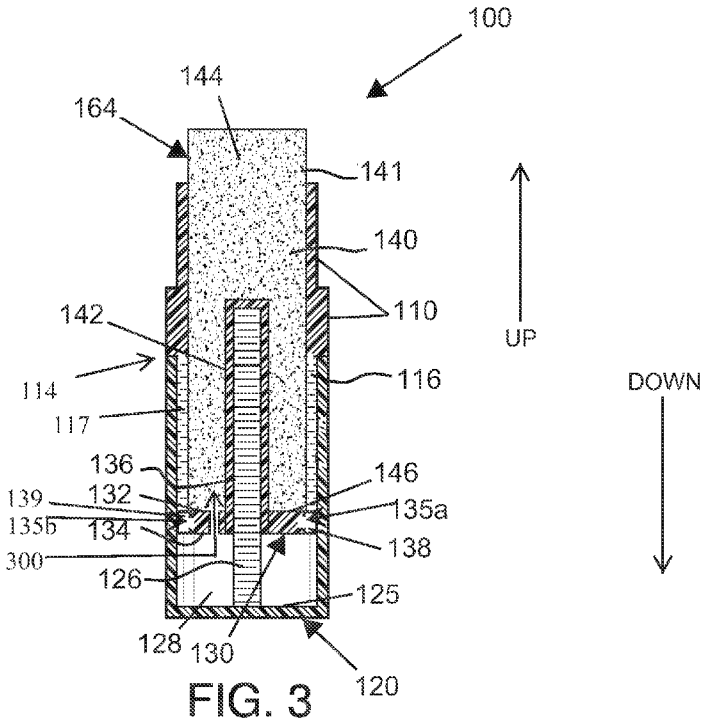
FIG. 3 shows a cross-sectional view of the present invention.
Figure 4:
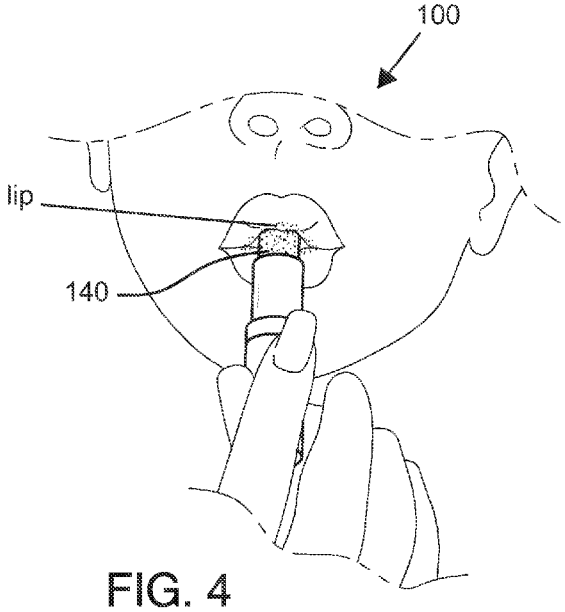
FIG. 4 shows a front view of the present invention in use.
Figure 5:
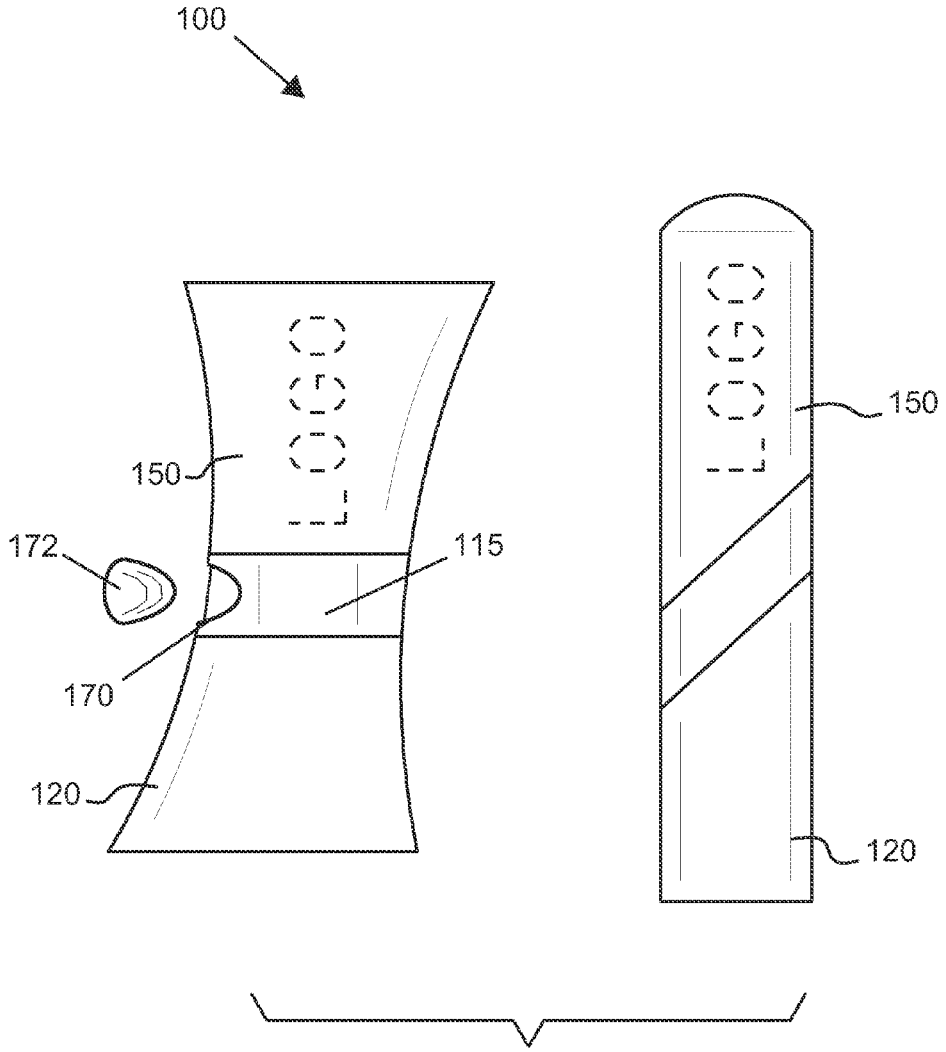
FIG. 5 shows a front view of alternate embodiments of the present invention.
Figure 6:
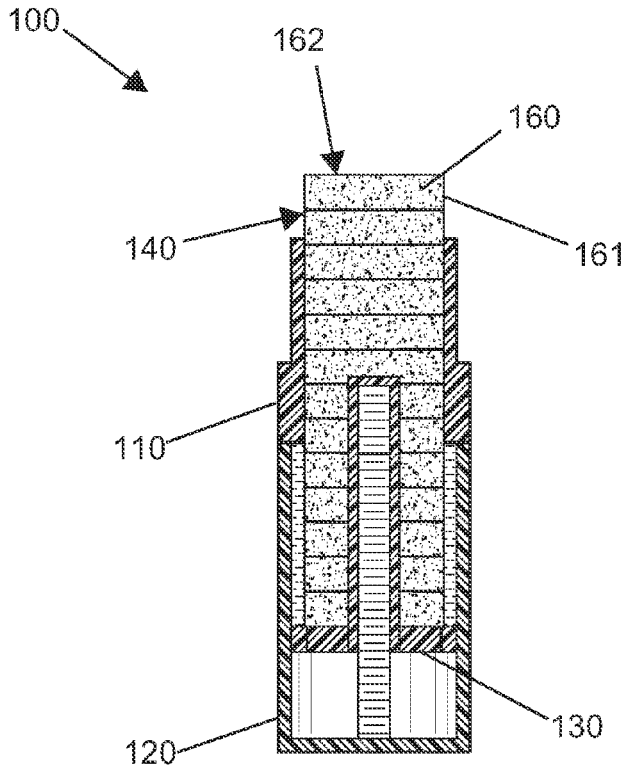
FIG. 6 shows a cross-sectional view of an alternate embodiment of the present invention.
Figure 7:
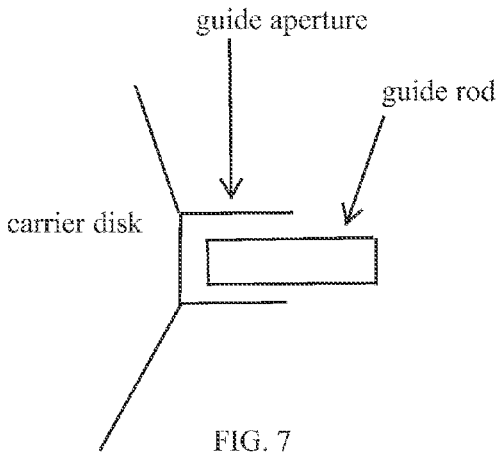
FIG. 7 shows a top view of the guide aperture disposed on the carrier disk where the guide aperture engages the guide rod, which inhibits a side spinning movement but allows for an up and down slide movement.

Following is a list of elements corresponding to a particular element referred to herein:

100 Lipstick blotting system
110 Stationary base
112 Stationary base anterior end
114 Stationary base posterior end
115 Stationary base side wall
116 First guide rod
118 Shoulder
120 Rotating base
122 Rotating base anterior end
124 Rotating base posterior end
125 Rotating base posterior end interior surface
126 Threaded rod
128 Solution
130 Carrier
132 Carrier anterior surface
134 Carrier posterior surface
135 Carrier first side
136 Threaded tube
138 First guide aperture
140 Blotter
141 Blotter side
142 Channel
144 Blotter anterior end
146 Blotter posterior end
150 Cap
152 Cap anterior end
154 Cap posterior end
160 Cotton disk
161 Disk outside edge
162 Stack
164 Cartridge
170 Elliptical aperture
172 Elliptical cap Referring now to FIG. 1-6, the present invention features a lipstick blotting system (100) for use after lipstick application. In some embodiments, the system (100) comprises a tubular stationary base (110) having an open stationary base anterior end (112) and an open stationary base posterior end (114). In some embodiments, a first guide rod (116) is located on and extends out and away from the stationary base posterior end (114). In some embodiments, a shoulder (118) is located around the stationary base (110). In some embodiments, the stationary base (110) is designed for gripping by a hand of a user. In some embodiments, the stationary base (110) is cylindrical.

In some embodiments, the system (100) comprises a rotating base (120) having an open rotating base anterior end (122) and an enclosed rotating base posterior end (124). In some embodiments, the rotating base (120) comprises a threaded rod (126) affixedly located on a rotating base posterior end interior surface (125). In some embodiments, the rotating base (120) is cylindrical.

In some embodiments, the stationary base (110) rotates with respect to the rotating base (120). In some embodiments, the stationary base (110) seals against the rotating base (120). In some embodiments, the stationary base posterior end (114) is permanently inserted through the rotating base anterior end (122). In some embodiments, the rotating base (120) is rotatable in a first direction and a second direction when holding the stationary base (110) in a static position via the hand of the user. In some embodiments, the threaded rod (126) rotates along with the rotating base (120).

In some embodiments, the system (100) comprises a carrier (130) having a carrier anterior surface (132) and a carrier posterior surface (134). In some embodiments, the carrier (130) comprises an elongated internally threaded tube (136) located on and projecting out and away from the carrier anterior surface (132). In some embodiments, the carrier (130) comprises a first guide aperture (138) located on a carrier first side (135) thereon. In some embodiments, the carrier (130) comprises a second guide aperture located on a carrier second side thereon.

In some embodiments, the carrier (130) is located in and fully enclosed by the rotating base (120) via the internally threaded tube (136) matingly interfacing with the threaded rod (126). In some embodiments, the carrier (130) is inhibited from rotation via the first guide rod (116) slidably located through the first guide aperture (138). In some embodiments, the carrier (130) is inhibited from rotation via the second guide rod slidably located through the second guide aperture.

In some embodiments, the system (100) comprises an elongated blotter (140) having a blotter posterior end (146) located on the carrier anterior surface (132). In some embodiments, the blotter (140) comprises a linear channel (142) centrally located therein. In some embodiments, the blotter (140) is located over the threaded tube (136) via the channel (142). In some embodiments, a blotter anterior end (144) is designed to contact a lip of the user. In some embodiments, the linear channel (142) extends from the blotter posterior end (146) past a midpoint of the blotter (140) but does not reach the blotter anterior end (144).

In some embodiments, the system (100) comprises a solution (128) sealably located in the rotating base (120). In some embodiments, the solution is stored in the rotating base (120). In some embodiments, the solution (128) is designed to permeate the blotter (140) to dissolve unwanted lipstick. In some embodiments, the dissolved unwanted lipstick is suspended in the solution (128) and stored in the rotating base (120). In some embodiments, the solution (128) comprises hydrogen peroxide. In some embodiments, the solution (128) is hydrogen peroxide in water, e.g., 3% hydrogen peroxide. In some embodiments, the solution (128) comprises alcohol. In some embodiments, the solution (128) comprises isopropyl alcohol. In some embodiments, the solution (128) comprises petroleum jelly. In some embodiments, the solution (128) comprises propylene glycol.

In some embodiments, the system (100) comprises a cap (150) having an enclosed cap anterior end (152) and an open cap posterior end (154). In some embodiments, the cap (150) is adapted to sealably attach to the stationary base anterior end (112). In some embodiments, the cap (150) sealably interfaces with the shoulder (118). In some embodiments, the cap (150) comprises a mirror disposed inside.

In some embodiments, the cap (150) is removed for use. In some embodiments, the stationary base (110) is held securely via the hand of the user. In some embodiments, the rotating base (120) is rotated in the first direction. In some embodiments, upon rotation of the rotating base (120), the blotter (140) extends through the stationary base anterior end (112). In some embodiments, the blotter anterior end (144) is dabbed against the lip of the user having freshly applied lipstick located thereon. In some embodiments, the blotter (140) is retracted via rotating the rotating base (120) in the second direction. In some embodiments, the blotter (140) is located in the solution (128). In some embodiments, the cap (150) is replaced for storage. In some embodiments, the cap (150) comprises a gasket for sealing.

In some embodiments, the blotter (140) is a sponge. In some embodiments, the blotter (140) is a cosmetic sponge. In some embodiments, the blotter (140) is a cellulose sponge. In some embodiments, the blotter (140) is a velour powder sponge. In some embodiments, the blotter (140) is a latex sponge. In some embodiments, the blotter (140) is a sea sponge.

In some embodiments, the blotter (140) comprises a stack (162) of woven cotton disks (160). In some embodiments, the cotton disks (160) are detachably attached around each disk outside edge (161) to form the stack (162). In some embodiments, upon completion of use, a top woven cotton disk (160) is removed and discarded.

In some embodiments, the blotter (140) and the carrier (130) comprise a replaceable cartridge (164). In some embodiments, the blotter (140) and the carrier (130) are permanently connected to each other. In some embodiments, the rotating base (120) is rotated in a first direction until the replaceable cartridge (164) falls free and is no longer located on the rotating base (120). In some embodiments, a new replaceable cartridge (164) is placed on the threaded rod (126) via the threaded tube (136). In some embodiments, the first guide rod (116) is aligned with and located through the first guide aperture (138).

In some embodiments, one or more elliptical apertures (170) are located in a stationary base side wall (115). In some embodiments, an elliptical cap (172) or plug is located over the elliptical aperture (170). In some embodiments, a blotter side (141) is accessible through the elliptical aperture (170). In some embodiments, the blotter side (141) is dabbed against the lip of the user having freshly applied lipstick thereon.

In some embodiments, the blotter (140) comprises a shaveable material. For example, in some embodiments, after blotting, the blotter anterior end (144) can have a topmost layer shaved via a cutting device for providing a fresh, unused surface for blotting. In some embodiments, the cap (150) comprises a cutting device located therein for shaving the topmost layer of the blotter anterior end (144) for discarding.

As used herein, the term "about" refers to plus or minus 10% of the referenced number.

The disclosures of the following U.S. Patents are incorporated in their entirety by reference herein: U.S. Pat. No. 4,628,564; U.S. Pat. No. 5,285,799; U.S. Pat. No. 6,013,344; U.S. Pat. No. 7,310,846; U.S. Pat. No. D 354,374; U.S. Pat. No. D 456,099; and U.S. Patent Publication No. 2009/0258326.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A lipstick blotting system (100) for use after lipstick application, wherein the system (100) comprises:

(a) a tubular stationary base (110) having an open stationary base anterior end (112), and an open stationary base posterior end (114), wherein a first guide rod (116) and a second guide rod (117) is disposed on and extends downwardly and away from the stationary base posterior end (114), wherein a shoulder (118) is disposed around an outside periphery of the stationary base (110), wherein the stationary base (110) is designed for gripping by a hand of a user;

(b) a rotating base (120) having an open rotating base anterior end (122) and an enclosed rotating base posterior end (124), wherein the rotating base (120) comprises a threaded rod (126) affixedly disposed on a rotating base posterior end interior surface (125) and projecting upwardly;

wherein the stationary base (110) is rotatably disposed onto the rotating base (120), wherein the stationary base posterior end (114) glides on the rotating base anterior end (122), wherein the rotating base (120) is rotatable in a first direction and a second direction when holding the stationary base (110) in a static position via the hand of the user;

(c) a carrier disk (130) having a carrier anterior surface (132), a carrier posterior surface (134), a first carrier side rim (135*a*) and a second carrier side rim (135*b*), wherein the carrier disk (130) comprises an elongated internally threaded tube (136) disposed on and projecting upwardly and away from the carrier anterior surface (132), wherein the carrier disk (130) comprises a first guide aperture (138) disposed on the carrier first side rim (135*a*) and a second guide aperture (139) disposed on the carrier second side rim (135*b*);

wherein the first guide rod (116) reaches down from the stationary base (11) and inserts through the first guide aperture (138), and the second guide rod 117 reaches down from the stationary base (11) and inserts through the second guide aperture (139) disposed on the carrier disk (130);

wherein the carrier disk (130) is disposed in the rotating base (120) via the internally threaded tube (136) matingly interfacing with the threaded rod (126), wherein the carrier (130) is inhibited from rotation via the first guide rod (116) and the second guide rod (117) that are inserted into the first and second guide aperture disposed on the carrier disk, respectively; wherein the carrier disk (130) slides up and down along the first and second guide rods via the first and second guide aperture;

(d) an elongated blotter (140) having a blotter posterior end (146) disposed on the carrier anterior surface (132), wherein the blotter (140) comprises a linear channel (142) centrally disposed therein, wherein the blotter (140) is disposed over the threaded tube (136) via the channel (142), wherein a blotter anterior end (144) is designed to contact a lip of the user;

(e) a solution (128) disposed in the rotating base (120) in a cavity below the carrier disk; the carrier disk (130) further comprises a seep hole (300) through which the solution can seep into the elongated blotter (140); wherein the solution (128) is designed to permeate the blotter (140) to dissolve unwanted lipstick; and (f) a cap (150) having an enclosed cap anterior end (152) and an open cap posterior end (154), wherein the cap (150) is adapted to sealably attach to the stationary base anterior end (112), wherein the cap sealably interfaces with the shoulder (118);

wherein the cap (150) is removed for use, wherein the stationary base (110) is held securely via the hand of the user, wherein the rotating base (120) is rotated in the first direction, wherein upon rotation of the rotating base (120), the blotter (140) extends through the stationary base anterior end (112), wherein the blotter anterior end (144) is dabbed against the lip of the user having freshly applied lipstick disposed thereon, wherein the blotter (140) is retracted via rotating the rotating base (120) in the second direction, wherein the blotter (140) is disposed in the solution (128), wherein the cap (150) is replaced for storage.

2. The system (100) of claim 1, wherein the blotter (140) is a sponge.

3. The system (100) of claim 1, wherein the blotter (140) is a cosmetic sponge.

4. The system (100) of claim 1, wherein the blotter (140) is a cellulose sponge.

5. The system (100) of claim 1, wherein the blotter (140) is a velour powder sponge.

6. The system (100) of claim 1, wherein the blotter (140) is a latex sponge.

7. The system (100) of claim 1, wherein the blotter (140) is a sea sponge.

8. The system (100) of claim 1, wherein the blotter (140) comprises a stack (162) of woven cotton disks (160), wherein the stack (162) of cotton disks (160) comprises cotton disks (160) that are detachably attached around each disk outside edge (161), wherein upon completion of use, a top woven cotton disk (160) is removed and discarded.

9. The system (100) of claim 1, wherein the blotter (140) and the carrier (130) comprise a replaceable cartridge (164), wherein the rotating base (120) is rotated in a first direction until the replaceable cartridge (164) falls free and is no longer disposed on the rotating base (120), wherein a new replaceable cartridge (164) is disposed on the threaded rod (126) via the threaded tube (136), wherein the first guide rod (116) is aligned with and disposed through the first guide aperture (138).

10. The system (100) of claim 1, wherein one or more elliptical apertures (170) are disposed in a stationary base side wall (115), wherein an elliptical cap (172) is sealably disposed over the elliptical aperture (170), wherein a blotter side (141) is accessible through the elliptical aperture (170), wherein the blotter side (141) is dabbed against the lip of the user having freshly applied lipstick thereon.

* * * * *